US007067192B2

(12) United States Patent
Fujita et al.

(10) Patent No.: US 7,067,192 B2
(45) **Date of Patent: *Jun. 27, 2006**

(54) TRANSFER FILM, METHOD FOR FABRICATING THIN FILM FOR DISPLAY APPARATUS PANEL USING THE TRANSFER FILM, AND DISPLAY APPARATUS HAVING THIN FILM FABRICATED BY THE METHOD

(75) Inventors: Koji Fujita, Kanagawa (JP); Katsutoshi Ohno, Tokyo (JP); Kazumasa Nomura, Tokyo (JP)

(73) Assignee: Sony Corporation (JP)

( * ) Notice: Subject to any disclaimer, the term of this patent is extended or adjusted under 35 U.S.C. 154(b) by 45 days.

This patent is subject to a terminal disclaimer.

(21) Appl. No.: 11/067,785

(22) Filed: Mar. 1, 2005

(65) Prior Publication Data

US 2005/0139866 A1 Jun. 30, 2005

Related U.S. Application Data

(63) Continuation of application No. 09/859,638, filed on May 18, 2001, now Pat. No. 6,861,146.

(30) Foreign Application Priority Data

May 23, 2000 (JP) ..... P2000-151141

(51) Int. Cl.
*H01J 9/227* (2006.01)

(52) U.S. Cl. ..... 428/411.1; 428/423.7; 428/328; 428/457; 428/704; 313/112

(58) Field of Classification Search ..... 313/46, 313/112, 478, 481, 477 R, 480, 479, 489, 313/461, 466; 428/343, 704, 423.7, 337, 428/457, 367, 408, 41.1, 328, 472.2, 411.1, 428/461, 466

See application file for complete search history.

(56) References Cited

U.S. PATENT DOCUMENTS

| | | | | |
|---|---|---|---|---|
| 3,893,877 | A | 7/1975 | Libman | |
| 3,910,806 | A | 10/1975 | Schwartz | |
| 3,954,011 | A | 5/1976 | Manske | |
| 4,248,918 | A | 2/1981 | Hornibrook et al. | |
| 4,919,873 | A | 4/1990 | Oishi et al. | |
| 5,130,180 | A * | 7/1992 | Koshizuka et al. | 428/212 |
| 5,137,780 | A | 8/1992 | Nichols et al. | |
| 5,141,461 | A | 8/1992 | Nishimura et al. | |
| 5,244,714 | A | 9/1993 | Malhotra et al. | |
| 5,418,075 | A | 5/1995 | Utsumi | |
| 5,439,872 | A * | 8/1995 | Ito et al. | 503/227 |

(Continued)

FOREIGN PATENT DOCUMENTS

| | | |
|---|---|---|
| EP | 0 382 554 | 8/1990 |

(Continued)

*Primary Examiner*—Ashok Patel
(74) *Attorney, Agent, or Firm*—Rader, Fishman & Grauer PLLC; Ronald P. Kananen

(57) ABSTRACT

A transfer film capable of transferring thin films such as a conducting film, a heat absorption film onto a display apparatus panel, a method for fabricating thin films for a display apparatus panel using the transfer film, and a display apparatus having thin films fabricated by the method are provided. The transfer film is constructed by forming a conducting film layer and an adhesion layer on a base film. The transfer film is disposed on the display apparatus, and a heat pressure adhesive bonding process is performed to transfer the conducting film layer to the display apparatus. A high quality display apparatus is realized by fabricating a high quality conducting film using the transferring process.

1 Claim, 3 Drawing Sheets

U.S. PATENT DOCUMENTS

| | | | |
|---|---|---|---|
| 5,639,330 | A | 6/1997 | Otake |
| 5,985,419 | A | 11/1999 | Schlueter et al. |
| 5,985,464 | A | 11/1999 | Schmitt et al. |
| 5,993,920 | A | 11/1999 | Kim |
| 6,395,375 | B1 | 5/2002 | Imamura et al. |
| 6,420,309 | B1 | 7/2002 | Grime et al. |
| 6,482,556 | B1 | 11/2002 | Ohno et al. |

FOREIGN PATENT DOCUMENTS

| | | |
|---|---|---|
| JP | 63-102139 | 5/1988 |
| JP | 01-67933 | 7/1989 |
| JP | 11-003675 | 1/1999 |
| JP | 02-033825 | 2/1999 |
| JP | 11-242939 | 9/1999 |

* cited by examiner

TRANSFER FILM, METHOD FOR FABRICATING THIN FILM FOR DISPLAY APPARATUS PANEL USING THE TRANSFER FILM, AND DISPLAY APPARATUS HAVING THIN FILM FABRICATED BY THE METHOD

This is a continuation application of Ser. No. 09/859,638, filed on May 18, 2001 now U.S. Pat. No. 6,861,146, the entire contents of which are hereby incorporated by reference.

BACKGROUND OF THE INVENTION

1. Technical Field of the Invention

The present invention relates to a transfer film, a method for fabricating a thin film for a display apparatus, and a display apparatus having the thin film fabricated by the method.

2. Description of the Related Art

In the production of a color cathode ray tube panel, technology for fabricating a so-called metal back layer is widely employed. The metal back layer is fabricated by using an aluminum vacuum evaporation deposition process on a fluorescent substance layer formed on an inner surface of the panel, so as to increase the luminance of a color cathode ray tube. Furthermore, there is technology (e.g. Japanese Patent Application laid-open No. 11-242939) for absorbing heat reflection from an aperture grille (shadow mask) by forming a black color layer on the aluminum deposition layer, i.e. inside of the metal back layer. Such technology is employed to prevent color shift caused by the shifting of electron beam landing positions due to temperature drift. Such temperature drift may be caused by the heating up of the aperture grille due to electron beams bombardments.

Such technology will now be described with reference to FIG. 4 showing a cross sectional view of the color cathode ray tube construction. As shown in FIG. 4, a florescent substance layer 52 is formed on the inside surface of a color cathode ray tube panel 51 toward a side of an electron gun 61. A metal back layer 53 is formed with the aluminum vacuum evaporation deposition process so as to cover inside the florescent substance layer 52. Further, a black color layer 54 is formed to the cover inside surface of the metal back layer 53.

FIG. 4 shows a schematic view of the florescent substance layer 52 to help the reader's understanding, and a detail construction is omitted. In practice, florescent substance stripes or florescent substance dots corresponding to colors representing red, green and blue are formed on predetermined positions of the black color layer 54 disposed inside the surface of panel 51. Then, an intermediate layer is provided to smooth a surface on which the florescent substance stripes or florescent substance dots are mounted.

The black color film 54 absorbs heat radiation generated at the aperture grille 55 disposed near the metal back film 53 and heated up due to electron beam MB bombardments. The black color film 54 is operable to prevent radiation/reflection from the inside surface of the metal back layer 53 to the aperture grille 55. Accordingly, the heat expansion coefficient of the aperture grille 55 is reduced.

In one of conventional methods for fabricating the black color film 54, the metal back film 53 is formed with the aluminum vacuum evaporation deposition on each color cathode ray tube panel, and the black color film 54 is attached onto the metal back film 53 by spray painting of graphite solved in organic solvent. In the other conventional method, the black color film 54 of aluminum oxide is fabricated by performing another aluminum vacuum evaporation deposition process with a higher pressure (about 0.1–0.01 Torr) than that of the first aluminum vacuum evaporation deposition process to form the metal back film 53.

SUMMARY OF THE INVENTION

There are drawbacks in the color cathode ray tube panel fabrication method in which the above-cited methods are used for forming the metal back film or the black color film.

The spray painting method is implemented since graphite has a low evaporation pressure and is difficult to use for the vacuum evaporation deposition process. However, there are drawbacks, such as the variation of film thickness, and the film tends to peel off easily. It is difficult to form a good graphite film (black color film) which can resolve those drawbacks. Furthermore, in the spray painting method, the graphite may penetrate into the florescent substance layer when there are some cracks in the aluminum deposition film (metal back film), whereby black spots or color drifts are generated.

In the aluminum oxide black color film (blackened film) fabrication method with performing the second aluminum vacuum evaporation deposition after forming the aluminum deposition film, there is the advantage that the fabrication process of the aluminum metal back film and the fabrication process of the aluminum oxide black color film for heat absorption may be performed in the same production apparatus by simply changing processing pressure. On the other hand, there are effects of residual gases in the production apparatus and interferences among deposition molecules evaporated from a plurality of thermal evaporation sources, since the evaporation process takes place in low pressure vacuum. These effects may cause variation in the black color film disposed on the inside surface of the panel. Such variation in the thickness of the black color film may cause luminescent variation of the color cathode ray tube and deterioration of the image quality.

There is another conventional method for fabricating magnesium film or barium film. However, it is difficult to perform a stable film deposition unless pressures inside the panel and residual gas densities are carefully controlled when the magnesium film or the barium film is fabricated.

In all of the conventional methods described above, the entire film deposition process is separately performed for each color cathode ray tube panel. For example, in order to fabricate the aluminum metal back film, the panel is placed inside a vacuum chamber having a color cathode ray tube panel mounting stage, and then the vacuum chamber is evacuated. After the vacuum chamber is vacuumed, aluminum disposed inside the vacuum chamber is heated to evaporation, and the metal back film of aluminum is formed inside the panel. After the metal back film is formed, the panel is removed from the vacuum chamber, and another panel is set in turn in the vacuum chamber. Then, the series of processes starting from the vacuuming of the vacuum chamber is repeated again. Accordingly, considerable manpower is required.

The present invention is made by considering the above-cited situation. An object of the present invention is to provide a transfer film capable of forming a thin film on a panel of the display apparatus, such as a color cathode ray tube. Another object of the present invention is to provide a method for fabricating a thin film for a display apparatus panel by using a transfer film. Still another object of the present invention is to provide a display apparatus having a thin film fabricated by the method according to the present invention.

In accordance with an embodiment of the present invention, a transfer film constructed by forming a conducting film layer and an adhesion layer on a base film is provided. The transfer film enables the formation of a high quality conducting film layer on the display apparatus panel.

In accordance with another embodiment of the present invention, a transfer film constructed by forming a heat absorption film layer, a conducting film layer and an adhesion layer on a base film is provided. The transfer film enables the formation of a high quality heat absorption film layer and a conducting film layer on the display apparatus panel.

The present invention provides a method for fabricating a thin film for the display apparatus panel in which the transfer film constructed by forming a conducting film layer and an adhesion layer on a base film, or the transfer film constructed by forming a heat absorption film layer, a conducting film layer and an adhesion layer on a base film, is disposed on the display apparatus panel. The conducting film layer or a set of the conducting film layer and the heat absorption film layer is transferred to the display apparatus panel by heating and pressing the transfer film. According to the present invention, the high quality conducting film and/or heat absorption film may be fabricated.

The present invention provides a display apparatus having the conducting film layer or a set of the conducting film layer and the heat absorption film layer transferred from either the transfer film constructed by forming a conducting film layer and an adhesion layer on a base film or the transfer film constructed by forming a heat absorption film layer, a conducting film layer and an adhesion layer on a base film. According to the present invention, the image quality of the display apparatus may be promoted.

Other and further objects, features and advantages of the present invention will appear more fully from the following description.

DESCRIPTION OF THE PREFERRED EMBODIMENTS

An embodiment of the present invention will now be described with reference to the figures.

Figure 1:
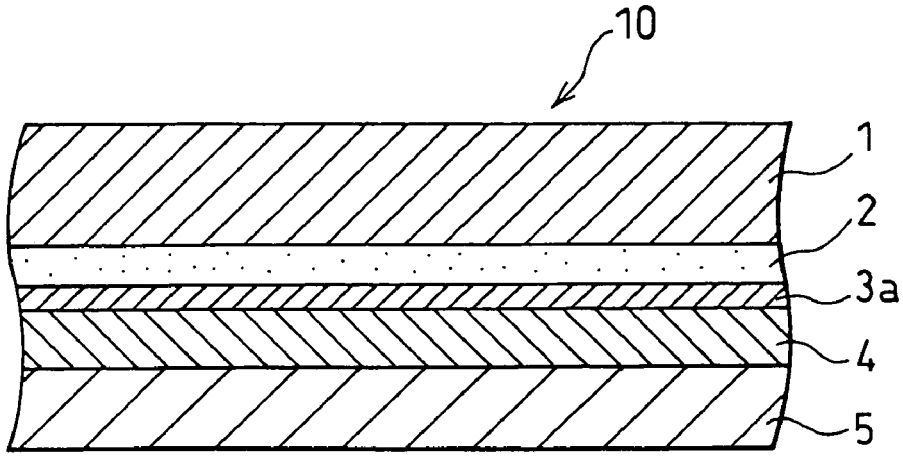
FIG. 1 is an expanded cross sectional view showing a part of a transfer film in accordance with an embodiment of the present invention.

FIG. 1 is an expanded cross sectional view of a part of a transfer film in accordance with an embodiment of the present invention.

A transfer film 10, according to the present embodiment, is constructed by forming a cushion layer 2, a conducting film layer 3*a*, an adhesion layer 4 and a cover film 5 layer by layer on a base film 1.

The base film 1 may be a long film consisting essentially of, for example, polyethylene terephthalate (PET). The width of the film may be equal to or approximately equal to a height of the front side plane of the color cathode ray tube, for example. The thickness of the base film 1 is not limited to any particular values in the present embodiment. For example, a thickness may be set to a value with which the film may endure against pulling tensile force along the longitudinal direction of the film applied during the transfer process, which will be described below, thereby preventing accidents like cutting of the film.

The cushion layer 2 is formed on the base film 1. The cushion layer 2 is provided for helping the base film 1 to be peeled off easily from the conducting film layer 3*a* without damaging the conducting film layer 3*a*, and for alleviating vibrations from, for example, a pressing roller, thereby preventing damage to the conducting film layer 3*a*. Accordingly, the cushion layer 2 is fabricated so as to exhibit stronger adhesiveness at the contacting surface with the base film 1 and weaker adhesiveness at the contacting surface with the conducting film layer 3*a*. The thickness of the cushion layer 2 is not limited to a particular value in the present embodiment. For example, the thickness of the cushion layer 2 may be set to an arbitrary value as long as the impact of the pressing roller is taken into consideration.

The conducting film layer 3*a* is formed on the cushion layer 2. The conducting film layer 3*a* composes the metal back film by transferring itself onto the luminescent substance layer disposed inside the surface of the color cathode ray tube, for example. The conducting film layer 3*a* may be formed with an aluminum vacuum evaporation process.

The adhesion layer 4 is formed on the conducting film layer 3*a*. The adhesion layer 4 is adhered to the inside of the color cathode ray tube by heating and being pressed.

The cover film 5 is formed on the adhesion layer 4. The cover film 5 is provided for protecting the adhesion layer and for easier handling of the transfer film 10.

The transfer film 10 of the present embodiment may be fabricated in-line with a predetermined method while the long base film 1 is being continuously transported. Accordingly, the aluminum deposition film composing the conducting film layer 3*a* may be fabricated in a high quality, as long as the aluminum deposition film can keep a mirror surface condition with no damage like cracks.

Figure 2:
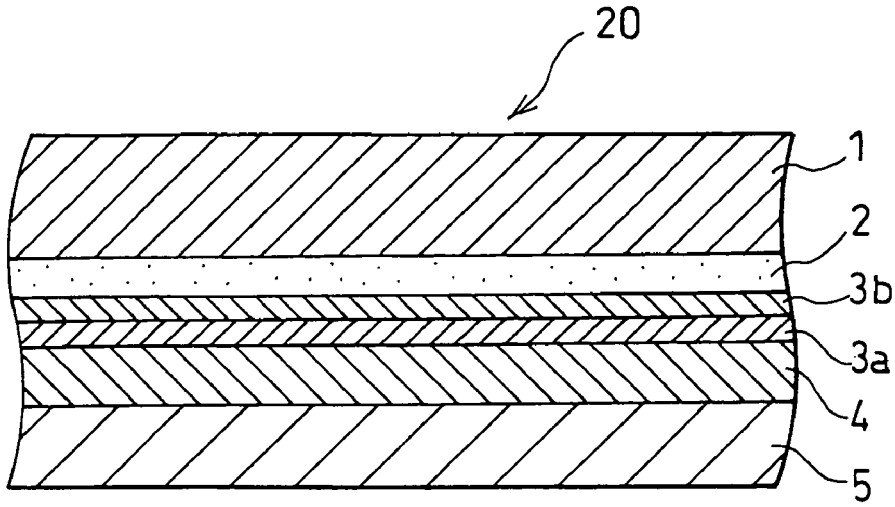
FIG. 2 is an expanded cross sectional view showing a part of a transfer film in accordance with another embodiment of the present invention.

FIG. 2 is an expanded cross sectional view showing a part of a transfer film in accordance with another embodiment of the present invention.

The transfer film 20 of the present embodiment has the same construction as that of the transfer film 10 shown in FIG. 1, except that the conducting film layer 3*a* is formed on a thermal absorption film layer 3*b* and the absorption film layer 3*b* is formed on the cushion layer 2 of the transfer film 10 shown in FIG. 1. The same construction elements as those of FIG. 1 are designated with the same numerals as FIG. 1, and operations and effects of these redundant elements are not discussed in the following description.

The cushion layer 2 is fabricated so as to exhibit stronger adhesiveness at the contacting surface with the base film 1 and weaker adhesiveness at the contacting surface with the thermal absorption film layer 3*b*. Accordingly, the cushion layer 2 and the heat absorption film layer 3*b* can be separated easily.

The heat absorption film layer 3*b* has the function of absorbing heat from the aperture grille when the heat absorption film layer 3*b* is transferred and disposed onto the color cathode ray tube panel with the conducting film layer 3*a*. The heat absorption film layer 3*b* may be formed as a black color film by using the spray painting of graphite.

The transfer film 20 of the present embodiment may be fabricated in-line with a predetermined method while the long base film 1 is being continuously transported, in the same manner as the transfer film 10 shown in FIG. 1. Accordingly, the black color film of graphite composing the heat absorption film layer 3*b* may be fabricated while keeping a constant film thickness, and the aluminum deposition film composing the conducting film layer 3*a* may be fabricated with a high quality, as long as the aluminum deposition film can maintain the mirror surface condition.

A method for fabricating a thin film on the display apparatus panel using a transfer film in accordance with an embodiment of the present invention will now be described.

Figure 3:
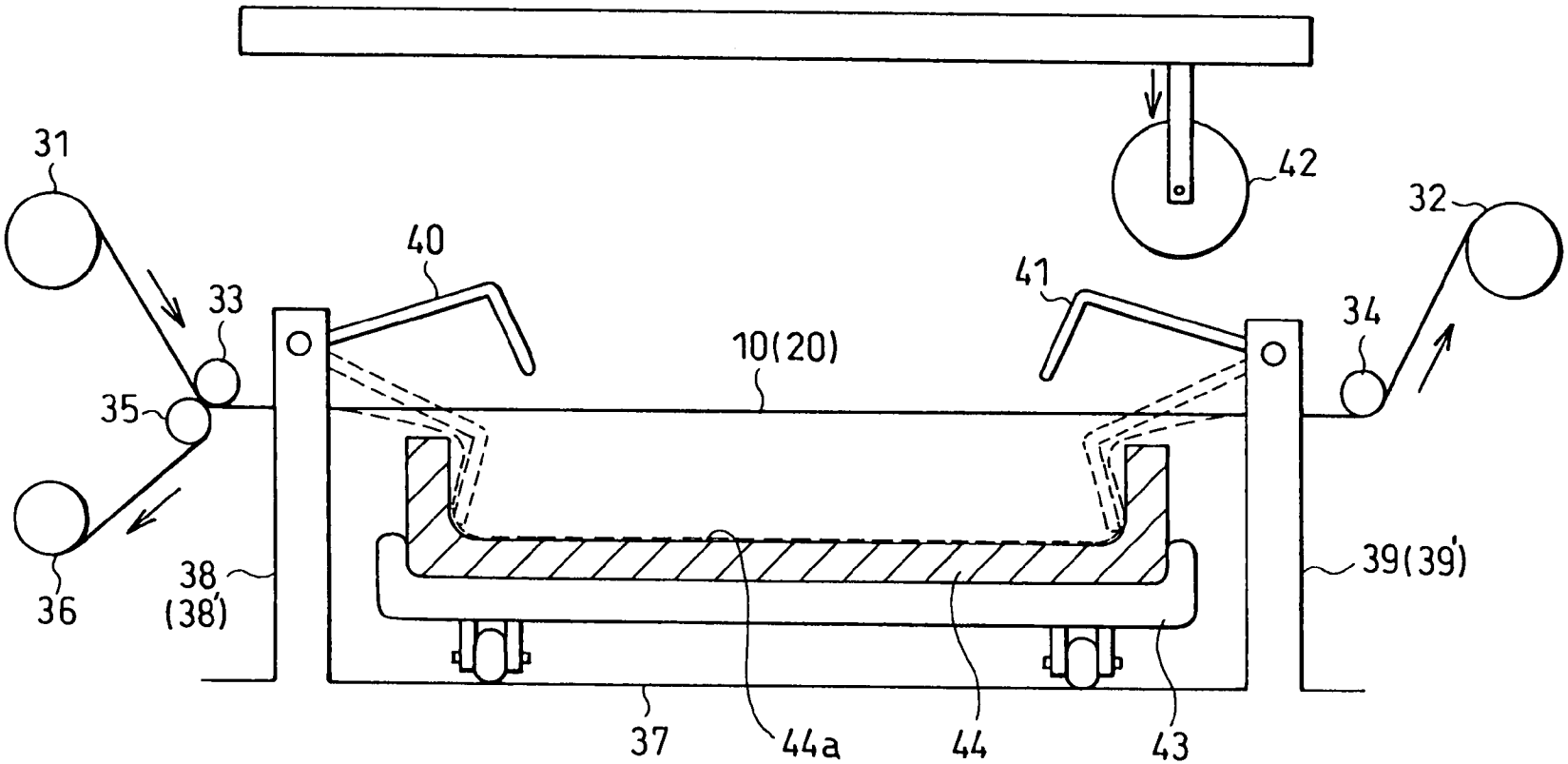
FIG. 3 is a schematic cross sectional view showing an apparatus for forming a thin film on a color cathode ray tube panel to explain another embodiment of the present invention.
Figure 4:
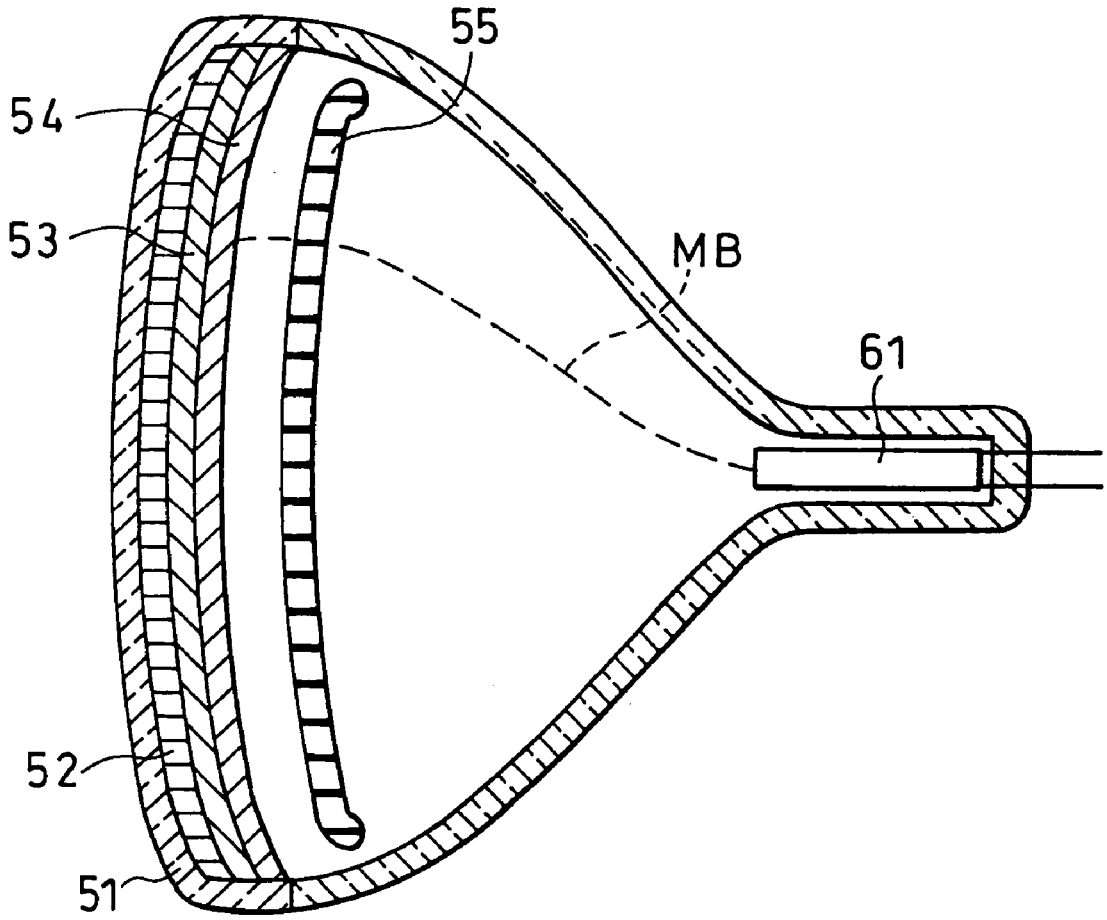
FIG. 4 RELATED ART
FIG. 4 is a schematic cross sectional view showing a construction of the color cathode ray tube of the related art.

FIG. 3 is a schematic cross sectional view showing an apparatus for forming the thin film on the color cathode ray tube panel for an explanatory purpose in accordance with the present embodiment.

As shown in FIG. 3, the transfer film 10 is mounted on a roller 31, and is taken up by a roller 32 via rollers 33, 34. In the present embodiment, the transfer film 10 is mounted in the roller 31 in such a way that the base film 1 is facing outward (upward direction in the figure) and the cover film 5 facing inward (downward direction in the figure). Accordingly, the base film 1 faces upward and the cover film downward when the transfer film 10 is transported from the roller 31 and transported toward the roller 32.

Rollers 35, 36 are disposed in the vicinity of the roller 33. The roller 35 is positioned to face the roller 33. The cover film 5 is peeled off from the transfer film 10 taken up from the roller 31 by separating at the adhesion layer 4, and rolled up by the roller 36 via the rollers 33, 35. Accordingly, the transfer film 10 with the adhesion layer 4 exposed is transported to the rollers 34, 32.

In the present embodiment, there is tensile force applied on the transfer film 10 between the rollers 33 and 34. The tensile force may be applied, for example, by increasing the rotational friction coefficient of the roller 31 and/or the rotational drive force of the roller 32.

The apparatus for forming the thin film of the present embodiment comprises a base plate 37 and support members 38, 39, 38', 39'. The support members 38 and 38' are disposed along the lateral direction of the transfer film 10 (orthogonal direction to the page plane of FIG. 3) so as to face each others across the transfer film 10 with the separation distance the same as or approximately the same as the width of the transfer film 10. The support members 39, and 39' are similarly disposed. Plate members 40 and 41 are disposed between the support members 38, 38' and the support members 39, 39', respectively. The plate members 40 and 41 have a L-shaped cross section and are connected to the support members 38–38' and the support members 39–39' so as to allow the plate members 40 and 41 to turn.

A pressing roller 42, essentially consisting of silicon material, is disposed above the support members 38–38' and the support members 39–39'. The pressing roller 42 is supported by any appropriate members so as to allow the motion of the pressing roller 42 along the up/down direction and the horizontal direction between the support members 38(38'), 39(39'). Further, a transportation apparatus 43 is disposed on the base plate 37 between the support members 38(38') and 39(39'). The transportation apparatus 43 moves along the direction transverse to the transfer direction of the transfer film 10 (e.g., from the front side to the back side of the page in FIG. 3). The transportation apparatus 43 carries a color cathode ray tube panel 44 with its inner surface 44*a* facing upward to a point directly below the transfer film 10. The florescent substance layer is formed on the inner surface 44*a* of the color cathode ray tube panel 44 and is not shown in the figure.

The transportation apparatus 43 moves directly below the transfer film 10 and stops at a position in which the width edge positions of the transfer film 10 and the corresponding width edge positions of the color cathode ray tube panel 44 are aligned. After the transportation apparatus 43 has stopped, the plate members 40, 41 turn toward the color cathode ray tube panel 44. The positions of the plate members 40, 41 after they have been turned are indicated by dotted lines in FIG. 3. With the turning of the plate members 40, 41, the transfer film 10 is pulled down by the plate members 40, 41 to the inner surface 44*a* of the color cathode ray tube panel 44, and the adhesion layer 4 of the transfer film 10 comes into contact with the inner surface 44*a* of the color cathode ray tube panel 44. The position of the transfer film 10 after the turning of the plate members 40, 41 is indicated by a dotted line in FIG. 3. Then, the pressing roller 42, which is heated up to a predetermined temperature (e.g., 100° C.), is lowered to press the transfer film 10. The pressing roller 42 is rolled while applying a predetermined pressure (e.g., 1 kg/cm$^2$) on the inner surface 44*a* from one peripheral part of the color cathode ray tube panel 44 to the other peripheral part (e.g., right hand side to left hand side of FIG. 3). Accordingly, the transfer film 10 is bonded with the inner surface 44*a* of the color cathode ray tube panel 44 by the thermal-pressure, adhesive-bonding process of the adhesion layer 4.

When the pressing roller 42 reaches the end, i.e. the other peripheral part (the left side of FIG. 3 in this example) of the color cathode ray tube panel 44, the roller 42 is elevated and the plate members 40, 41 turn upward to return to the initial positions. In the present embodiment, the shape and/or diameter of the pressing roller 42 may be selected to appropriate values so that the transfer film 10 can be uniformly heated and perform the pressure-adhesive bonding process on the whole area of the inner surface 44*a* of the color cathode ray tube panel 44.

A constant tensile force is applied on the transfer film 10 between the rollers 33 and 34. The cushion layer 2 of the transfer film 10 is adhered to the base film 1 and the conducting film layer 3*a*. The cushion layer 2 has a weaker adhesive strength with the conducting film layer 3*a*, thereby the cushion layer 2 may be easily separated from the conducting film layer 3*a*. Accordingly, the base film 1 and the cushion layer 2 of the transfer film 10 are separated from the conducting film layer 3*a* and go back to the original position shown with the real line in FIG. 3 when the pressing roller 42 is elevated and the plate members 40, 41 are returned to the initial positions. The conducting film layer 3*a* remains on the inner surface 44*a* of the color cathode ray tube panel 44 due to the adhesion layer 4, thereby realizing transfer and attachment of the conducting film layer 3*a* from the transfer film 10 to the color cathode ray tube panel 44.

In the above, the method of fabricating the conducting film on the color cathode ray tube panel 44 by transferring and attaching the conducting film layer 3*a* from the transfer film 10 shown in FIG. 1 is described. A similar method may be used for fabricating the heat absorption film and the conducting film on the color cathode ray tube panel from the transfer film 20.

In the method for fabricating the heat absorption film and the conducting film, the transfer film 20 shown in FIG. 2, instead of the transfer film 10 shown in FIG. 1, is mounted on the roller 31 of FIG. 3. The transfer film 20 is mounted so as that the side with the base film 1 faces upward and the side with the cover film 5 downward. The cover film 5 is taken up by the roller 36, and the rest of the transfer film 20 is taken up by the roller 32 via the rollers 33, 34. The heat absorption film layer 3*b* and the conducting film layer 3*a* may be transferred and attached on the inner surface 44*a* of the color cathode ray tube panel 44 by a method similar to the method used for the heat pressure adhesive bonding process of the conducting film layer 3*a* of the transfer film 10.

The operations and process relating to the transfer process described above, such as transportation of the color cathode ray tube panel 44, rolling up of the transfer film 10 or 20, operation of the pressing roller 42 and plate members 40, 41, are controlled and executed by a control apparatus and a drive apparatus (not shown in the figure), respectively, as a series of operation and a process in accordance with a predetermined sequence.

According to the embodiments of the present invention, the transfer film is configured in such a way that the cushion layer 2, the graphite heat absorption film layer 3*b*, the aluminum conducting film layer 3*a*, the adhesion layer 4, and the cover film 5 are formed layer by layer. Accordingly, the film layers may be fabricated with a high quality. For example, the aluminum conducting film layer may be able to maintain the mirror surface condition, the distribution of film thickness of the graphite heat absorption film layer may be kept uniform, and so on. Further, according to the embodiments of the present invention, the high quality heat absorption film layer 3*b* and the conducting film layer 3*a* may be transferred onto the cathode ray tube panel. Temperature drifts may be alleviated since the heat absorption film layer 3*b* has a uniform film thickness distribution.

The cushion layer 2 is disposed so that the heat absorption film layer 3*b* or the conducting film layer 3*a* is weakly adhered with the cushion layer 2, and thereby the base film 1 may be easily separated at the cushion layer 2. In the transferring process, the heat absorption film layer 3*b* or the conducting film layer 3*a* may be easily separated from the base film 1 and the cushion layer 2 when the base film 1 is separated from the heat absorption film layer 3*b* or the conducting film layer 3*a* with the cushion layer 2, due to the tensile force applied on the base film 1. Accordingly, the heat absorption film layer 3*b* or the conducting film layer 3*a* may be transferred and bonded to the color cathode ray tube panel 44 without causing any damage, such as cracks on these layers.

In a conventional method for fabricating the aluminum-conducting film on the color cathode ray tube panel, more manpower is required since the aluminum vacuum evaporation deposition process is performed by setting each color cathode ray tube panel inside a vacuum evaporation apparatus separately, exhausting gases to vacuum, and heating up a source heater. On the other hand, the transfer process in accordance with the embodiments of the present invention enables fabrication of the heat absorbing film 3*b* or the conducting film 3*a* with only a small amount of manpower, since the transfer process is performed by using the heat pressure adhesive bonding process while the pressing roller 12 is being rolled from one peripheral part to the other peripheral part of the color cathode ray tube panel 44.

In the transfer process, operations such as transportation of the color cathode ray tube panel, rolling up of the transfer film, lowering of the pressing roller, scan rolling of the pressing roller, disposing of the transfer film to the inner surface of the panel by turning of the plate members, and elevating the pressing roller, are executed as a series of operations in accordance with a predetermined sequence. Accordingly, efficient operations may be realized, and productivity may be promoted in manufacturing the color cathode ray tube.

According to the embodiments of the present invention, the conventional intermediate film to maintain the mirror surface condition of the aluminum conducting film 3*a* formed on the inner surface 44*a* of the color cathode ray tube panel 44 may be eliminated, and thereby drawback relating to the intermediate film may be resolved. Further, the productivity of the color cathode ray tube panel may be promoted, since the step for fabricating the intermediate film can be eliminated.

Furthermore, the luminance may not be decreased and the temperature drift may be alleviated, since the heat absorption film (graphite film) fabricated by the transfer process has a uniform film thickness distribution. Further, the luminance of the color cathode ray tube may be promoted since the conducting film (metal back film) can maintain the mirror surface condition. Accordingly, a color cathode ray tube with better image quality may be realized in accordance with the embodiments of the present invention.

The present invention is described for examples in which the present invention is applied on the color cathode ray tube panel. However, the present invention is not limited to such examples only, and it can be applied to other display apparatus, such as plasma display panels (PDP). In such a case, the present invention enables the fabrication of an electrode film (conducting film) by the transfer process of the present invention when the electrode film (conducting film) is formed on a panel substrate of the display apparatus.

According to the present invention, a high quality conducting film or a set of high quality conducting film and heat absorption film may be fabricated, since the transfer film is configured so that the conducting film or the conducting film and the heat absorption film is/are formed on the base film layer by layer.

Further, according to the present invention, a conducting film or heat absorption film with high quality may be fabricated, since the conducting film layer or the heat absorption film layer is transferred by the heat pressure adhesive bonding process from the transfer film configured by forming the conducting film or the conducting film and the heat absorption film on the base film layer by layer.

Further, according to the present invention, a high quality display apparatus may be realized, since the conducting film or the conducting film and the heat absorption film may be realized with a high quality in the cathode ray tube panel having the conducting film layer or a set of the heat absorption film layer and the conducting film layer transferred by the heat pressure adhesive bonding process from the transfer film in accordance with the present invention.

What is claimed is:

1. A transfer film comprising:

a base film, a heat absorption film layer formed on said base film, a conducting film layer formed on said heat absorption film layer, and an adhesion layer formed on said conducting film layer, wherein the width of the base film is approximately equal to a height of the front side plane of the color cathode ray tube.

* * * * *

UNITED STATES PATENT AND TRADEMARK OFFICE

CERTIFICATE OF CORRECTION

PATENT NO. : 7,067,192 B2
APPLICATION NO. : 11/067785
DATED : June 27, 2006
INVENTOR(S) : Koji Fujita It is certified that error appears in the above-identified patent and that said Letters Patent is hereby corrected as shown below:

Column 8:
Lines 56 to 58 should read as follows:

-- Transfer film for a front side plate of a color cathode ray tube having an aperture grille, comprising:
a base film having a width,
a cushion layer formed on the base filem and having a stronger adhesiveness at a contacting surface with an adjacent layer than with the base layer,
a heat absorption film layer formed on said cushion layer for absorbing heat from the aperture grille when the transfer film is applied to the cathode ray tube, --.

Signed and Sealed this

Second Day of January, 2007

JON W. DUDAS
*Director of the United States Patent and Trademark Office*